US005775203A

United States Patent [19]

Osborn et al.

[11] Patent Number: 5,775,203

[45] Date of Patent: Jul. 7, 1998

[54] HIGH PRESSURE FUEL PUMP ASSEMBLY

[75] Inventors: J. Christopher Osborn; John W. Black, both of Columbus, Ind.

[73] Assignee: Cummins Engine Company, Inc., Columbus, Ind.

[21] Appl. No.: 789,804

[22] Filed: Jan. 28, 1997

[51] Int. Cl.[6] ..... F01B 29/00

[52] U.S. Cl. ..... 92/128; 92/129; 417/470

[58] Field of Search ..... 417/273, 470; 92/170.1, 129, 128, 73, 74

[56] References Cited

U.S. PATENT DOCUMENTS

| | | | |
|---|---|---|---|
| 1,976,151 | 10/1934 | Thaheld | 92/129 |
| 4,952,121 | 8/1990 | De Mattaeis et al. | 417/273 |
| 5,072,709 | 12/1991 | Long et al. . | |
| 5,382,140 | 1/1995 | Eisenbacher et al. | 417/273 |
| 5,404,855 | 4/1995 | Yen et al. . | |
| 5,409,165 | 4/1995 | Carroll, III et al. . | |
| 5,464,330 | 11/1995 | Prince et al. | 417/273 |

FOREIGN PATENT DOCUMENTS

| | | |
|---|---|---|
| 601034 | 8/1934 | Germany . |
| 603177 | 9/1934 | Germany . |
| 603330 | 9/1934 | Germany . |
| 2079382 | 1/1982 | United Kingdom . |
| 2131873 | 6/1984 | United Kingdom . |

OTHER PUBLICATIONS

*Compact High Performance Fuel System with Accumulator*, Cavanagh et al., PCT Patent Publication No. WO 94/27041, Nov. 24, 1994, Drawing Sheets 9, 10, 20, 22, and 29–33, pp. 32, 33, 54–59 and 81–94.

*Primary Examiner*—Charles G. Freay

*Attorney, Agent, or Firm*—Sixbey, Friedman, Leedom & Ferguson; Charles M. Leedom, Jr.; Tim L. Brackett, Jr.

[57] ABSTRACT

A high pressure fuel pump unit and assembly is provided which includes a pump barrel containing a bore, a pump plunger mounted in the bore for reciprocal movement between an advanced position and a retracted position, and a force transmitting device for transmitting axial loads to the plunger while minimizing side loads on the plunger. The force transmitting device includes an extension member extending into the inner radial extent of a bias spring and including a distal supporting end positioned in uncoupled abutment against a driven end of the pump plunger to form a decoupled force transmitting interface. The pump plunger and extension member are capable of relative lateral movement at the decoupled force transmitting interface which is positioned a spaced axial distance from the outer end of the pump barrel when the pump plunger is in the advanced position. The extension member is specifically formed with a predetermined axial length to minimize the spaced axial distance between the outer end of the pump barrel and the decouple force transmitting interface so as to minimize the leverage effect of any side loading and maximize the support provided to plunger by barrel throughout reciprocation of the plunger. The distal supporting end of the extension member may include a flat surface positioned in a single bearing plane wherein the extension member is positioned entirely on one side of the bearing plane to minimize the spaced axial distance.

20 Claims, 3 Drawing Sheets

HIGH PRESSURE FUEL PUMP ASSEMBLY

TECHNICAL FIELD

The present invention relates to a high pressure fuel pump assembly including a pump plunger which effectively minimizes side loads on the plunger during operation.

BACKGROUND OF THE INVENTION

An engine's fuel system is the component of the engine which often has the greatest impact on performance and cost. Accordingly, fuel systems for internal combustion engines have received a significant portion of the total engineering effort expended to date on the development of the internal combustion engine. For this reason, today's engine designer has an extraordinary array of choices and possible permutations of known fuel system concepts. Design effort typically involves extremely complex and subtle compromises among cost, size, reliability, performance, ease of manufacture and backward compatibility with existing engine designs.

The challenge to contemporary designers has been significantly increased by the need to respond to governmentally mandated emissions abatement standards while maintaining or improving fuel efficiency. In order to meet these standards, it is necessary to produce fuel systems capable of achieving higher injection pressures. One system capable of producing extremely high injection pressures is disclosed in PCT Patent Publication WO 94/27041, entitled Compact High Performance Fuel System with Accumulator, commonly assigned to the assignee of the present application. This accumulator-pump type fuel injection system includes a distributing device, i.e., a rotary distributor, positioned downstream of a high pressure accumulator for distributing fuel pulses to each injector via separate delivery lines, and a timing and metering device positioned along the fuel circuit between the accumulator and distributing device for determining the timing and metering of injection. A high pressure fuel pump operates to maintain the fuel in the accumulator at an extremely high pressure for injection into the engine. The high pressure pump includes two pump units, each comprised of a pump plunger reciprocally mounted in a bore formed in a pump barrel connected to the accumulator. The pump plunger is operated by a camshaft and a respective tappet assembly positioned between the plunger and the cam. The tappet assembly is mounted for reciprocation in a pump housing. Tappet guiding surfaces are machined in the pump housing to ensure smooth sliding contact between the tappet housing and the pump housing as the tappet reciprocates. Since the tappet guiding surfaces and the plunger bore are formed in separate components, the inherent tolerance and alignment differences in the manufacture and assembly of the components will necessarily result in some degree of misalignment between the respective axis of reciprocation of the plunger and tappet assembly. As a result, during reciprocation, the plunger and tappet will tend to move laterally relative to one another. In order to permit such relative lateral movement, the outer end of the plunger is positioned in abutment with a button which, in turn, slidably abuts the tappet at a slidable interface. A spring retainer is clipped on the outer end of the plunger to form a spring seat for a biasing spring which biases the plunger into abutment against the button and, thus, the button into abutment with the tappet. The spring retainer does not contact the tappet housing. This arrangement permits the button to slide laterally on the abutting tappet surface during reciprocation of the plunger and tappet assembly. However, it has been found that the above-described pump assembly results in a tendency of the plungers to seize in the respective barrel bores. In addition, the slidable interface between the plunger and button is positioned an unnecessarily large distance from the barrel supporting the plunger.

U.S. Pat. No. 5,404,855 to Yen et al. and commonly assigned to the assignee of the present application discloses a cam-driven roller tappet for displacing a high pressure pump plunger which is not connected to the tappet. The pump plunger is biased in abutment with the tappet solely by fuel pressure in a pump chamber. Also, a tappet bias spring surrounds the pump plunger for biasing the roller tappet into engagement with a cam. However, abutment between the plunger and the tappet assembly is not maintained by the fuel pressure throughout the cycle. Also, the reference fails to disclose the use of a spring retainer positioned between the pumping plunger and the roller tappet for abutment by both the plunger and the tappet bias spring.

U.S. Pat. No. 5,072,709 to Long et al. and commonly assigned to the assignee of the present application discloses a unit fuel injector including a timing plunger reciprocally mounted in the injector body and a coupling member for transmitting a compressive force to the timing plunger. The timing plunger includes a flat outer end surface which is maintained in abutment with a flat surface on the coupling member by hydraulic pressure acting on the timing plunger. Thus, the timing plunger is not mechanically coupled to the coupling member. The decoupling of the timing plunger minimizes side loading on the timing plunger thus preventing loading-induced scuffing and seizing of the timing plunger in its bore. However, the slidable interface between the timing plunger and coupling member is positioned an unnecessarily large distance from the barrel supporting the plunger.

U.K. Patent Application 2131873 discloses a unit fuel injector including a pump plunger, cam follower and a coil spring for urging the plunger towards a camshaft. U.K. Patent Application 2079382 is noted for disclosing a similar fuel injection pump assembly.

Consequently, there is a need for a simple, inexpensive high pressure fuel pump assembly which effectively minimizes side loading on the pump plunger.

SUMMARY OF THE INVENTION

It is an object of the present invention, therefore, to overcome the disadvantages of the prior art and to provide a high pressure fuel pump assembly including a plunger which effectively minimizes side loading on the plunger during operation.

Another object of the present invention is to provide a replaceable high pressure fuel pump unit, having minimal plunger side loading, for use in a fuel pump assembly.

It is yet another object of the present invention to provide a high pressure fuel pump assembly which reduces plunger scuffing and seizing during operation.

A still further object of the present invention is to provide a high pressure fuel pump assembly which decouples the plunger from the mechanism driving the plunger.

A further object of the present invention is to provide a high pressure fuel pump assembly including a plunger positioned in a barrel and a decoupled interface permitting lateral movement between the plunger and a driving assembly wherein the distance between the decoupled interface and the outer end of the barrel supporting the plunger is minimized.

Yet another object of the present invention is to provide a high pressure fuel pump assembly including a plunger operated by a force transmitting device wherein pressurized fuel supplied to a pump chamber maintains the plunger in abutment with the force transmitting device.

Still another object of the present invention is to provide a replaceable fuel pump unit capable of being retrofit on an existing high pressure fuel pump assembly including a pump head and drive shaft without expensive redesign of the fuel pump assembly so as to reduce the side loading on the plunger and thus the tendency of plunger seizing.

These and other objects are achieved by providing a replaceable high pressure fuel pump unit for use in a fuel pump assembly having a tappet assembly operated by a rotatable camshaft and a biasing spring having an inner radial extent for biasing the tappet assembly into engagement with the camshaft, wherein the fuel pump unit comprises a pump barrel containing a bore and an outer end forming a portion of the bore, a pump plunger mounted in the bore for reciprocal movement between an advanced position and a retracted position, and a force transmitting device positioned between the tappet assembly and the plunger for transmitting axial loads to the plunger while minimizing side loads on the plunger. The force transmitting device includes an extension member extending from the tappet assembly into the inner radial extent of the bias spring and including a distal supporting end positioned in uncoupled abutment against a driven end of the pump plunger to form a decoupled force transmitting interface. The pump plunger and extension member are capable of relative lateral movement at the decoupled force transmitting interface which is positioned a spaced axial distance from the outer end of the pump barrel when the pump plunger is in the advanced position. The extension member is formed with a predetermined axial length to minimize the spaced axial distance between the outer end of the pump barrel and the decoupled force transmitting interface. The replaceable high pressure fuel pump unit may also include a pump retainer surrounding the pump barrel for supportably mounting the pump unit on the fuel pump assembly. A pump chamber is formed in one end of the bore for receiving pressurized fuel which maintains the driven end of the plunger in abutment against the distal supporting end of the extension member. The distal supporting end of the extension member may include a flat surface positioned in a single bearing plane in abutment with the outer end of the plunger. Preferably, the extension member is positioned entirely on one side of the bearing plane to permit the spaced axial distance between the outer end of the barrel and the decoupled force transmitting interface to be minimized when the plunger moves into the advanced position. The extension member may include a seating surface for abutment by the bias spring and an annular retaining surface for securing the bias spring against lateral movement. The extension member may also include lubricating oil passages for transferring lubricating oil to and from the tappet assembly. The lubricating oil passages may include a cavity formed in the extension member and at least one transfer passage extending through the extension member to fluidically connect with the cavity. The transfer passage may include two passages formed on opposite sides of the extension member. Moreover, the extension member may include a spring retaining end positioned opposite the distal supporting end and a frusto-conically shaped intermediate portion connecting the spring retaining end and the distal supporting end. The transfer passage may be formed in the intermediate portion. Also, the spring retaining end is preferably mounted on the tappet assembly so as to prevent lateral movement of the extension member. In addition, the plunger may be designed with an axial length which is approximately the same length as the barrel. Also, the plunger may be formed of a ceramic material and include an outer cylindrical surface free from annular grooves.

A high pressure fuel pump assembly is also provided which includes the replaceable high pressure fuel pump unit described hereinabove in combination with a pump housing containing an outwardly opening pump cavity, a camshaft rotatably mounted on the pump housing, a pump head mounted on the pump housing to close the outwardly opening pump cavity, a tappet assembly mounted for reciprocal movement in the pump cavity in response to rotation of the camshaft and a bias spring for biasing the tappet assembly into abutment with the camshaft.

DETAILED DESCRIPTION OF THE PREFERRED EMBODIMENT

Figure 1A:
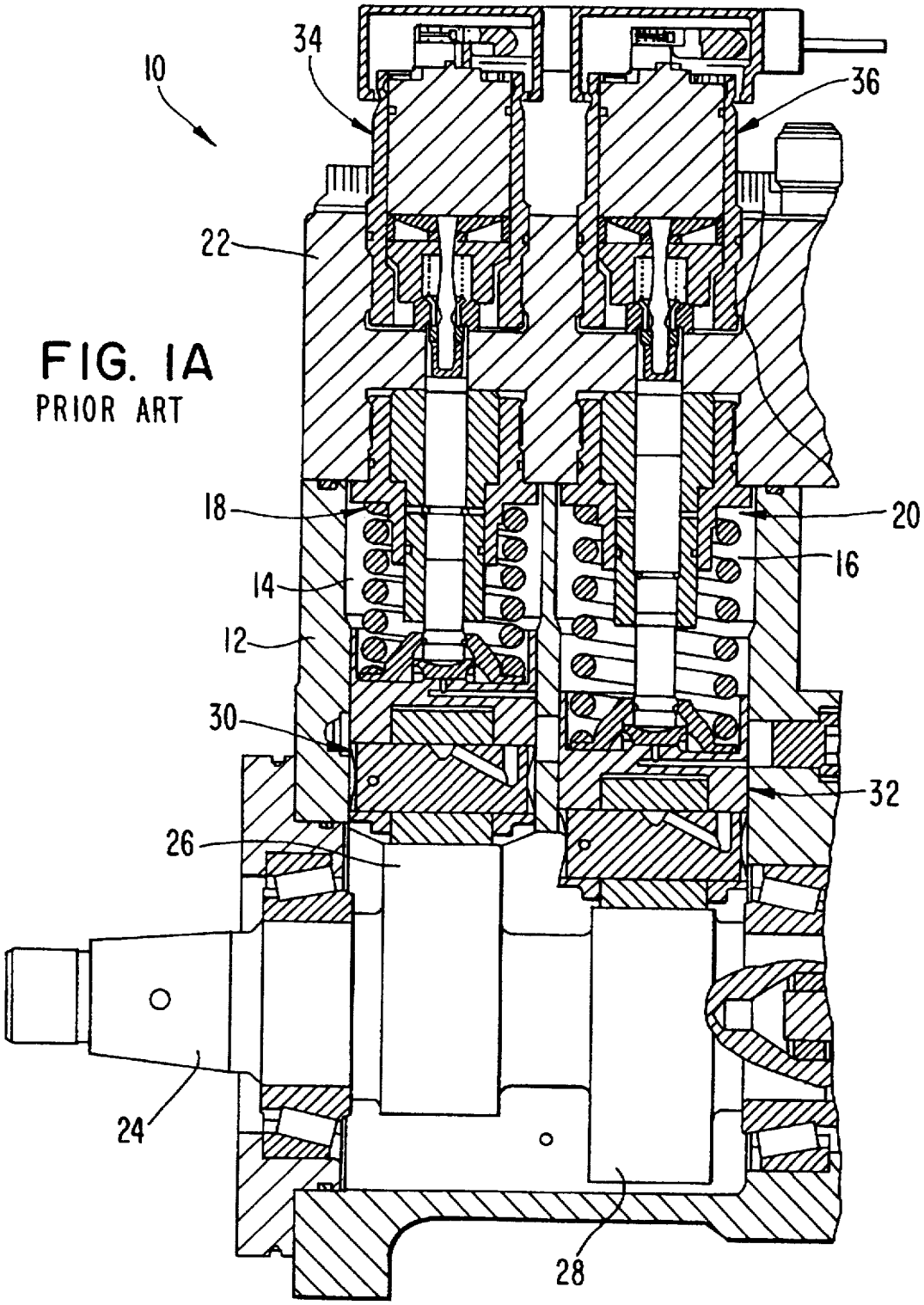
FIG. 1A PRIOR ART
FIG. 1A is a partial cross sectional view of a conventional high pressure fuel pump assembly.
Figure 1B:
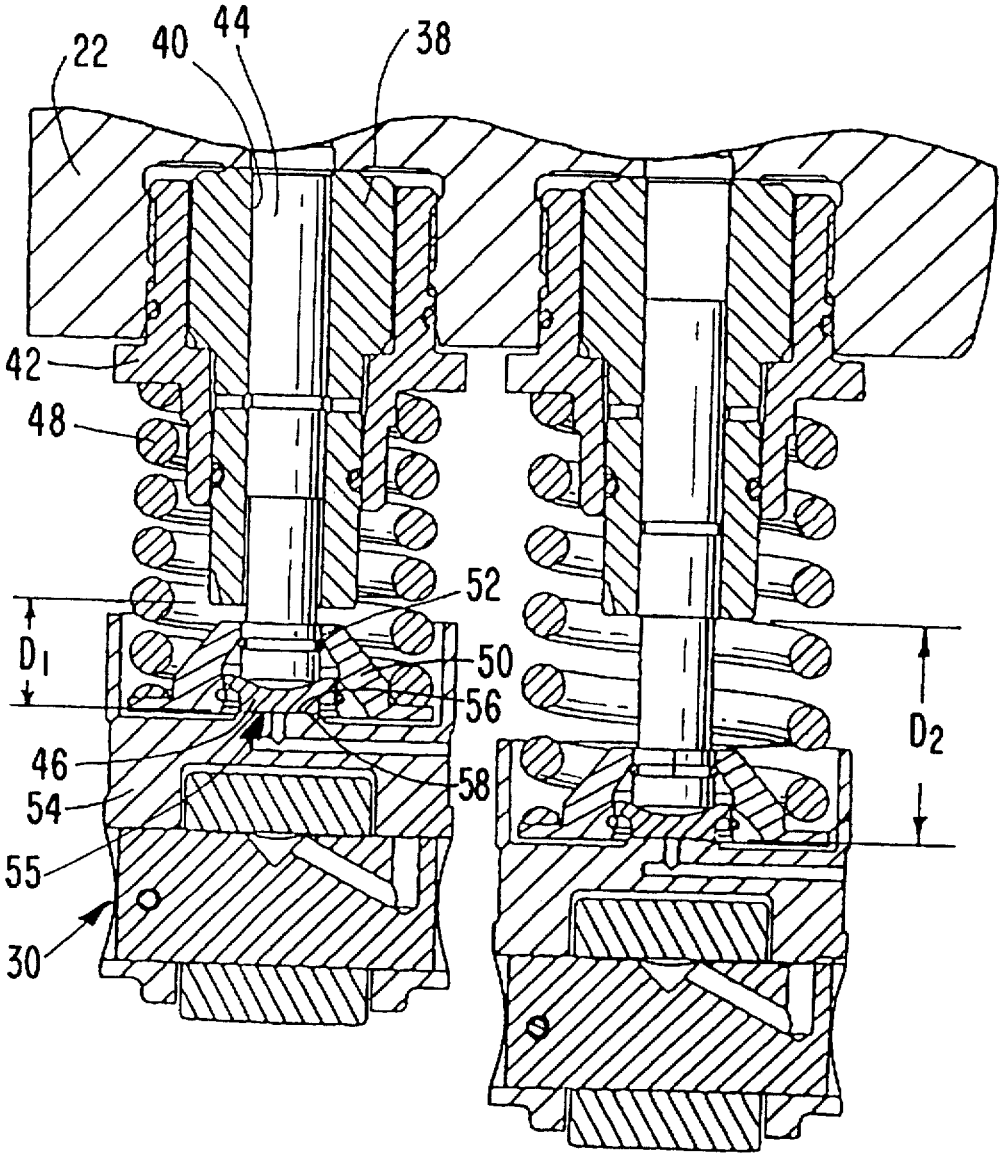
FIG. 1B PRIOR ART
FIG. 1B is an exploded, partial cross sectional view of the conventional high pressure fuel pump assembly of FIG. 1A including the replaceable pump units and the tappet assemblies.

FIGS. 1A and 1B are provided to clearly show the advantages of the improved high pressure fuel pump assembly of the present invention over a conventional high pressure fuel pump assembly. FIG. 1A represents a prior art high pressure fuel pump assembly incorporated into an accumulator-pump type fuel injection system. One such system is disclosed in PCT Patent Publication WO 94/27041, entitled Compact High Performance Fuel System with Accumulator, the entire contents of which is hereby incorporated by reference. Fuel pump assembly 10 generally includes a pump housing 12 forming outwardly opening cavities 14, 16 and replaceable pump units 18, 20 mounted in the respective cavities 14, 16. Fuel pump assembly 10 also includes a pump head 22 securely mounted on pump housing 12 so as to close outwardly opening cavities 14, 16. A rotatably mounted camshaft 24, having cams 26, 28, extends through pump housing 12 and functions to operate pump units 18, 20 via tappet assemblies 30, 32. Pump control valves 34, 36 are mounted on pump head 22 for controlling the amount of high pressure fuel delivered by pump units 18, 20 respectively, to, for example, accumulator chambers (not shown) formed in pump head 22 for ultimate delivery to an engine's cylinders via, for example, fuel injectors.

Referring to FIG. 1B, replaceable pump units 18 and 20 of fuel pump assembly 10 are structurally the same and, therefore, only pump unit 18 will be described hereinbelow. Replaceable pump unit 18 includes a pump barrel 38 having a bore 40, a pump retainer 42 securing barrel 38 in sealed abutment against pump head 22 and a plunger 44 reciprocally mounted in bore 40. The outer end of plunger 44 is reciprocally driven by tappet assembly 30 via a button 46. The outer end of plunger 44 is spherically shaped and biased into abutment with a complementary shaped surface formed in button 46 by a bias spring 48 via a spring retainer 50. Spring retainer 50 is coupled to the outer end of plunger 44 by a retaining ring 52, and positioned around button 46 and the outer end of plunger 44 so as to engage both button 46 and retaining ring 52. Tappet assembly 30 includes a tappet housing 54 having a flat bearing surface 56 for engagement by a complementary flat bearing surface 58 formed on the outer end of button 46 to create a slidable force transmitting interface 55. Thus, bias spring 48 continuously applies an axial force to the outer end of plunger 44 via spring retainer 50 so as to maintain plunger 44 in abutment with button 46 and thus button 46 in abutment with tappet housing 54 throughout reciprocation of tappet assembly 30 and plunger 44.

During operation, plunger 44 and tappet assembly 30 will tend to move laterally relative to one another due to inherent tolerance and alignment differences in the manufacture and assembly of the components. Specifically, tappet housing 54 is guided by tappet guiding surfaces machined in the pump housing 12 as tappet assembly 30 reciprocates. Since the tappet guiding surfaces and bore 40 of barrel 38 are formed in separate components, a certain unavoidable degree of misalignment exists between the respective axis of reciprocation of plunger 44 and tappet assembly 30 resulting in slight relative lateral movement. Such lateral movement is permitted by the slidable interface 55 which results in lateral movement of bearing surface 56 relative to bearing surface 58. Spring retainer 50 is spaced both axially and laterally from tappet housing 54. Since spring retainer 50 does not contact tappet housing 54, the outer end of bias spring 48, spring retainer 50 and button 46 are permitted to shift laterally relative to tappet housing 54 and bearing surface 56 so as to compensate for any misalignment.

Although the conventional fuel pump assembly 10 of FIGS. 1A and 1B permits lateral movement between tappet housing 54 and plunger 44, this conventional design results in excessive side loading of plunger 44 undesirably causing binding and seizing of the plunger during operation. The excessive side loads placed on plunger 44 are caused by at least three design features. First, spring retainer 50 is rigidly coupled to plunger 44 and rigidly abuts button 46 thereby permitting any lateral forces experienced by bias spring 48 and/or spring retainer 50, i.e. spring dynamics, to be transmitted directly to the outer end of plunger 44. Secondly, the attachment of bias spring 48, spring retainer 50 and button 46 to the outer end of plunger 44 creates an inertial mass which tends to increase the adverse effects of any laterally induced force on the plunger 44. Third, the slidable force transmitting interface 55 is positioned an unnecessarily large distance from the outer end of barrel 38 supporting plunger 44. As a result, any lateral forces or side loading applied to the outer end of plunger 44 create an undesirably large side load at the plunger/barrel interface due to the unnecessarily large distance, or moment arm, between the outer end of the plunger and the outer end of the barrel. For example, in the advanced position, any side loading could be applied through a moment arm as large as the distance between the outer end of barrel 38 and slidable force transmitting interface 55, indicated at $D_1$. In the retracted position, side loading on plunger 44 against barrel 38 caused by lateral forces acting on the outer portion of plunger 44 could act through a moment arm as large as the distance $D_2$.

Figure 2:
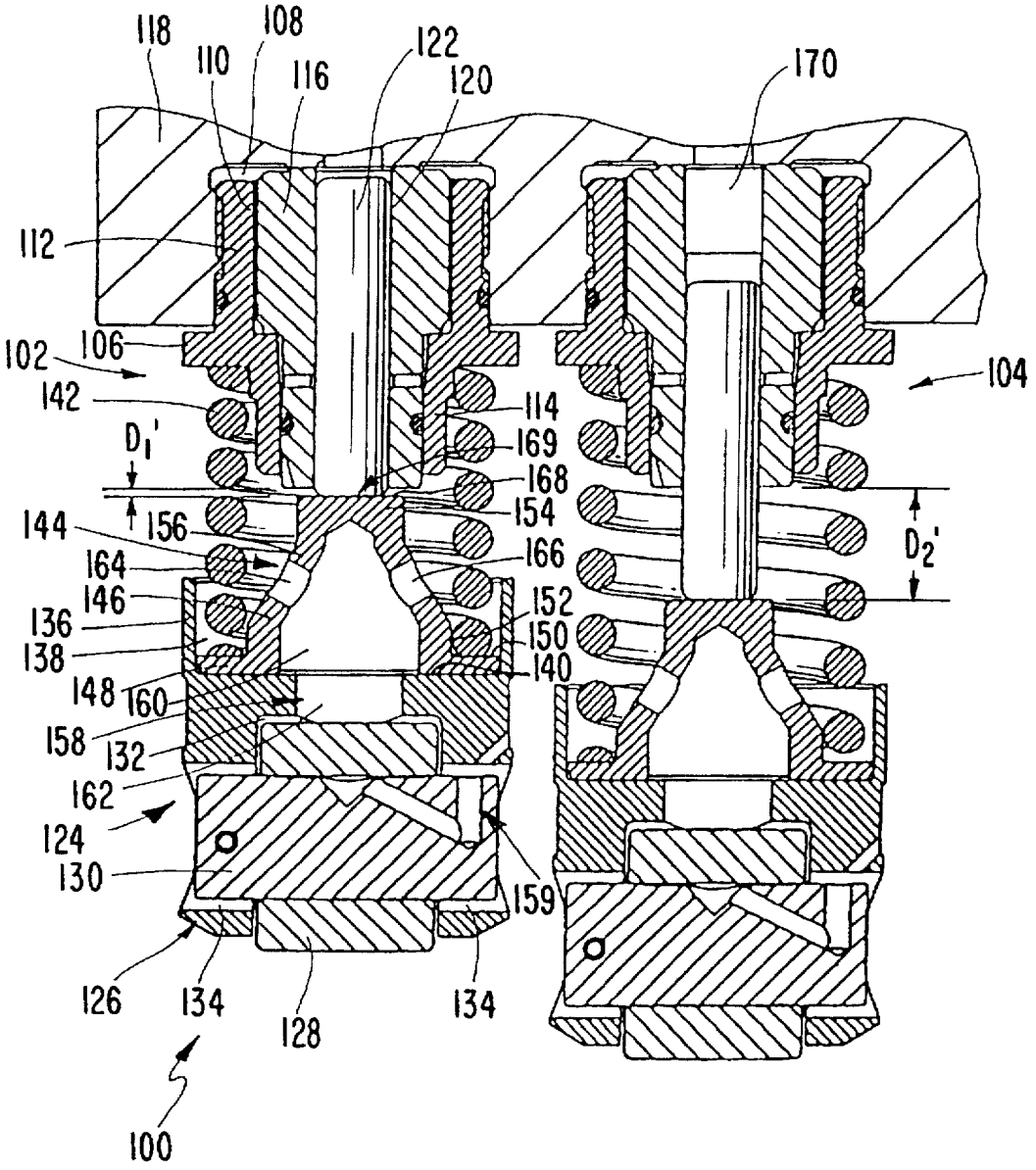
FIG. 2 is an exploded, partial cross sectional view of a portion of the high pressure fuel pump assembly of the present invention including the replaceable pump unit and tappet assembly.

Now referring to FIG. 2, the above-noted disadvantages of the prior art fuel pump assembly are minimized by the improved high pressure fuel pump assembly of the present invention. FIG. 2 illustrates the improved high pressure fuel pump assembly generally at 100 which incorporates the replaceable high pressure fuel pump units 102 and 104. Each replaceable high pressure fuel pump unit 102, 104 includes a pump retainer 106 positioned in a pump unit recess 108 and extending outwardly into a cavity formed by the pump housing (not shown). Although not shown in FIG. 2, it should be understood that improved high pressure fuel pump assembly 100 includes a pump housing and camshaft arrangement similar to that disclosed in FIGS. 1A and 1B. Pump retainer 106 is generally cylindrical in shape to form a cavity 110 and includes an upper portion 112 having external threads for engaging complementary threads formed on the inner surface of pump unit recess 108. Retainer 106 also includes a smaller diameter portion 114 extending into the pump cavity. Pump unit 102 also includes a pump barrel 116 mounted in cavity 110 and held in compressive abutting relationship against an annular surface formed on a pump head 118 when retainer 106 is fully threaded into recess 108. Barrel 116 includes a central bore 120 extending therethrough. Pump unit 102 also includes a plunger 122 reciprocally mounted in bore 120 for movement between an advanced position shown by pump unit 102 and a retracted position shown by pump unit 104.

A tappet assembly 124 includes a tappet housing 126 adapted for reciprocal motion along tappet guiding surfaces formed in the pump housing (not shown). Tappet assembly 124 includes a cam roller 128 rotatably secured to housing 126 by a pin 130 extending through a bore 132 into apertures 134 formed in tappet housing 126 on opposite sides of bore 132. Tappet housing 126 also includes an annular skirt 136 extending toward pump head 118 to form a recess 138 having an inner support surface 140. A coil bias spring 142 is positioned in abutment against retainer 106 at one end and biases tappet assembly 124 into engagement with a respective cam at an opposite end.

High pressure fuel pump unit 102 further includes a force transmitting device 144 positioned between tappet assembly 124 and plunger 122 for transmitting axial loads to plunger 122 while minimizing side loads on the plunger. Force transmitting device 144 includes an extension member 146 including a spring retaining end 148 positioned in axial abutment with inner support surface 140 of tappet housing 126. Spring retaining end 148 is also sized relative to the inner diameter of annular skirt 136 so as to prevent the lateral movement of extension member 146. Spring retaining end 148 includes a spring seating surface 150 for receiving the outer end of bias spring 142 and an annular retaining surface 152 sized to secure bias spring 142 against lateral movement.

Extension member 146 also includes a distal supporting end 154 for abutment by plunger 122 and an intermediate portion 156 extending between spring retaining end 148 and distal supporting end 154. Intermediate portion 156 is generally frusto-conically shaped so as to extend angularly toward the smaller distal supporting end 154. A lubricating oil circuit indicated generally at 158 includes various lubricating transfer passages 159 formed in the components of tappet assembly 124. In addition, lubricating oil circuit 158 includes a cavity 160 formed in extension member 146 for communication with an opening 162 formed in tappet housing 126. Lubricating oil circuit 158 also includes two passages 164, 166 formed opposite one another in frusto-conically shaped intermediate portion 156. Passages 164, 166 function to permit the flow of lubricating oil from opening 162 through cavity 160 into recess 138 and the reverse flow of lubricating oil from recess 138 into opening 162 via cavity 160 as tappet assembly 124 and extension member 146 reciprocate during operation. This design results in an optimum flow of lubricating oil through the fuel pump assembly to achieve optimum lubricating and cooling effects.

Distal supporting end 154 of extension member 146 includes a flat upper surface 168 for abutting a flat surface formed on the driven end of plunger 122 to form a decoupled force transmitting interface 169. Plunger 122 is held in abutment against flat surface 168 throughout reciprocation by fuel pressure induced forces acting on the inner end of the plunger due to the fuel pressure in a pump chamber 170 formed in bore 120. During the retraction stroke of plunger 122, the pressure of the fuel supplied to pump chamber 170 is maintained at a level sufficient to maintain plunger 122 in abutment against flat surface 168 at all engine speeds regardless of their retraction velocity of tappet assembly 124.

The present improved high pressure fuel pump assembly 100 overcomes the disadvantages of the prior art in several ways. First, plunger 122 is not connected in any manner to extension member 146 except at decoupled force transmitting interface 169. Since decoupled force transmitting interface 169 is formed by the uncoupled abutment of flat surface 168 and a flat surface formed on plunger 122, decoupled force transmitting interface 169 permits unhindered lateral relative movement between plunger 122 and extension member 146 so as to minimize side loads transmitted to plunger 122 during reciprocation due to, for example, alignment differences. Also, by decoupling plunger 122 from the remaining components, e.g. spring retainer and spring, except for the decoupled force transmitting interface 169, the transmission of other lateral forces, such as vibrations, are minimized. The decoupling of plunger 122 from the remaining components also decreases the inertial mass connected to the outer end of plunger 122 thereby also minimizing side loading. The present invention also importantly reduces, and minimizes, the distance between decoupled force transmitting interface 169 and the outer end of barrel 116 when plunger 122 is in both the retracted and advanced positions. For example, in the advanced position, the distance $D_1'$ indicates the minimal axial distance between decoupled force transmitting interface 169 and the outer end of barrel 116 supporting plunger 122. In the retracted position, as shown by pump unit 104, distance $D_2'$ indicates a reduced distance between decoupled force transmitting interface 169 and the outer end of barrel 116 over the conventional assembly of FIGS. 1A and 1B. Force transmitting device 144 achieves this advantage by providing extension 146 with a predetermined axial length sufficient to occupy substantially the entire axial distance between inner support surface 140 of tappet housing 126 and the outer end of barrel 116 when in the advanced position. As a result, the torque effects at barrel 116 due to the side loads on the outer end of plunger 122, acting through the moment arm equivalent to the distance between decoupled force transmitting interface 169 and the outer end of barrel 116, will be minimized by minimizing the moment arm or distance creating the torque effect. For example, although decoupled force transmitting interface 169 minimizes side loading, minimal side loading on plunger 122 may occur due to frictional forces between the outer end of plunger 122 and flat surface 168 at decoupled force transmitting interface 169. The torque effects of these frictional loads will thus be minimized by minimizing the moment arm, i.e. $D_1'$ and $D_2'$. Thus, the present invention functions synergistically to minimize side loading on plunger 122 by completely decoupling plunger 122 from the remaining components while providing decoupled force transmitting interface 169, and minimizing the distance between uncoupled force transmitting interface 169 and the outer end of barrel 116 thus minimizing the leverage effect of any side loading and maximizing the support provided to plunger 122 by barrel 116 throughout reciprocation of the plunger. The present assembly also functions as a simple, low cost device which can be easily retrofit on existing fuel pump assemblies to permit the effective minimization of plunger side loading without costly redesigns of existing systems.

INDUSTRIAL APPLICABILITY

The present high pressure fuel pump unit and assembly may be used to minimize plunger side loading in any reciprocating high pressure pump assembly for a high pressure fuel system, but is particularly advantageous as a retrofit assembly in existing high pressure fuel systems.

We claim:

1. A replaceable high pressure fuel pump unit for use in a fuel pump assembly having a tappet assembly operated by a rotatable camshaft and a biasing spring having an inner radial extent for biasing the tappet assembly into engagement with the camshaft, comprising:

a pump barrel containing a bore and an outer end forming a portion of said bore;

a pump plunger mounted in said bore for reciprocal movement between an advanced position and a retracted position, said plunger including an driven end;

a force transmitting means positioned between the tappet assembly and said plunger for transmitting axial loads to the plunger while minimizing side loads on said plunger, said force transmitting means including an extension member extending from the tappet assembly into the inner radial extent of the bias spring, said extension member including a distal supporting end positioned in uncoupled abutment against said driven end of said pump plunger to form a decoupled force transmitting interface, said pump plunger and said extension member capable of relative lateral movement at said decoupled force transmitting interface, said decoupled force transmitting interface being positioned a spaced axial distance from said outer end of said pump barrel when said pump plunger is in said advanced position, said extension member having a predetermined axial length so as to minimize said spaced axial distance between said outer end of said pump barrel and said decoupled force transmitting interface.

2. The replaceable pump unit of claim 1, further including a pump retainer surrounding said barrel for supportively mounting the pump unit on the fuel pump assembly.

3. The replaceable pump unit of claim 1, further including a pump chamber formed in one end of said bore for receiving pressurized fuel, wherein the fuel pressure maintains said driven end of said plunger in abutment against said distal supporting end of said extension member.

4. The replaceable pump unit of claim 2, wherein said distal supporting end of said extension member includes a flat surface positioned in a single bearing plane in abutment with said outer end of said plunger, said extension member positioned entirely on one side of said bearing plane.

5. The replaceable pump unit of claim 4, wherein said extension member includes a seating surface for abutment by the bias spring and an annular retaining surface for securing the bias spring against lateral movement.

6. The replaceable pump unit of claim 1, wherein said extension member includes lubricating oil passages for transferring lubricating oil to and from said tappet assembly.

7. The replaceable pump unit of claim 6, wherein said extension member includes a spring retaining end positioned opposite said distal supporting end and a frusto-conically shaped intermediate portion connecting said spring retaining end and said distal supporting end, said lubricating oil passages being formed is said frusto-conically shaped intermediate portion.

8. The replaceable pump unit of claim 1, wherein said plunger is approximately the same length as said barrel.

9. The replaceable pump unit of claim 1, wherein said plunger is formed of a ceramic material.

10. The replaceable pump unit of claim 9, wherein said plunger includes an outer cylindrical surface free from annular grooves.

11. A high pressure fuel pump assembly, comprising:

a pump housing containing an outwardly opening pump cavity;

a camshaft rotatably mounted in the pump housing;

a pump head mounted on the pump housing to close the outwardly opening pump cavity;

a tappet assembly mounted for reciprocal movement in said pump cavity in response to rotation of said camshaft;

a bias spring for biasing said tappet assembly into abutment with said camshaft, said bias spring having an inner radial extent;

a pump barrel mounted on said pump head and containing a bore;

a pump plunger mounted for reciprocal movement within said bore, said plunger including a driven end;

a force transmitting means mounted between said tappet assembly and said plunger for transmitting axial loads to said plunger while minimizing side loads on said plunger, said force transmitting means including an extension member extending into said inner radial extent of said bias spring, said extension member including a distal supporting end positioned in uncoupled abutment against said driven end of said pump plunger to form a decoupled force transmitting interface, said pump plunger and said extension member capable of relative lateral movement at said decoupled force transmitting interface; and a lubricating oil circuit for providing lube oil flow to the fuel pump assembly, said lubricating oil transfer circuit including at least one passage formed in said extension member.

12. The fuel pump assembly of claim 11, further including a pump retainer surrounding said barrel for supportively mounting said pump barrel on said pump head.

13. The fuel pump assembly of claim 12, further including a pump chamber formed in one end of said bore for receiving pressurized fuel, wherein the fuel pressure maintains said driven end of said plunger in abutment against said distal supporting end of said extension member.

14. The fuel pump assembly of claim 11, wherein said distal supporting end of said extension member includes a flat surface positioned in a single bearing plane in abutment with said outer end of said plunger, said extension member positioned entirely on one side of said bearing plane.

15. The fuel pump assembly of claim 14, wherein said extension member includes a seating surface for abutment by said bias spring and an annular retaining surface for securing said bias spring against lateral movement.

16. The fuel pump assembly of claim 11, wherein said plunger is formed of a ceramic material and includes an outer cylindrical surface free from annular grooves.

17. The fuel pump assembly of claim 11, wherein said at least one passage includes a cavity formed in said extension member and at least one transfer passage extending through said extension member to fluidically connect with said cavity.

18. The fuel pump assembly of claim 17, wherein said at least one transfer passage includes two passages formed on opposite sides of said extension member.

19. The fuel pump assembly of claim 17, wherein said extension member includes a spring retaining end positioned opposite said distal supporting end and a frusto-conically shaped intermediate portion connecting said spring retaining end and said distal supporting end, said at least one transfer passage being formed in said intermediate portion.

20. The fuel pump assembly of claim 15, wherein said seating surface is formed on a spring retaining end of said extension member, said spring retaining end mounted on said tappet assembly so as to prevent lateral movement of said extension member.

* * * * *